United States Patent [19]

Lassus

[11] Patent Number: 4,666,746

[45] Date of Patent: May 19, 1987

[54] METHOD FOR THE IMPREGNATION OF WATER-REPELLENT PAPER

[75] Inventor: Anders Lassus, Turku, Finland

[73] Assignee: Lännen Tehtaat Oy, Iso-Vimma, Finland

[21] Appl. No.: 865,421

[22] Filed: May 21, 1986

[30] Foreign Application Priority Data

May 22, 1985 [FI] Finland ..... 852056

[51] Int. Cl.[4] ..... B05D 3/02

[52] U.S. Cl. ..... 427/395; 162/158; 162/168.3; 427/391

[58] Field of Search ..... 427/391, 395; 162/158, 162/168.3

[56] References Cited

U.S. PATENT DOCUMENTS

| | | | |
|---|---|---|---|
| 3,139,373 | 6/1964 | Liggett | 162/180 |
| 4,311,767 | 1/1982 | Kennedy | 428/537 |
| 4,336,835 | 6/1982 | Takagishi et al. | 427/391 X |
| 4,536,254 | 8/1985 | Falk et al. | 427/395 X |
| 4,545,855 | 10/1985 | Sweeney | 427/395 X |

*Primary Examiner*—Thurman K. Page

*Attorney, Agent, or Firm*—Burns, Doane, Swecker & Mathis

[57] ABSTRACT

Method for the impregnation of water-repellent paper by using an ammonium salt of a substituted succinic acid amide as the moistening agent. The water-repellent properties of a paper impregnated in accordance with the method are restored after drying.

9 Claims, No Drawings

METHOD FOR THE IMPREGNATION OF WATER-REPELLENT PAPER

The invention concerns a method for the impregnation of water-repellent paper. By means of the method, desired agents can be impregnated into paper without deterioration of the water-repellent properties of the paper.

In this connection, the term paper also means paperboard, board, and other, similar products.

In this connection, the term water-repellent paper means paper to which, during or after manufacture, substances have been added that reduce the ability of the paper to absorb water. As examples may be mentioned stock sizing of paper, either the traditional "acid" sizing or neutral sizing, as well as surface sizing of paper.

In this connection, the term to impregnate means that that an agent in liquid form is added to the paper, which said agent is absorbed to the paper partly (surface treatment) or completely.

In order to alter the properties of paper, various additives may be added to the paper by impregnation. In this way, it is possible to improve, e.g., the dry- or wet-strength properties, water-repellency, rot-resistance, or the fire-proof properties of paper. The impregnation liquids used are solutions, dispersions and emulsions based on water.

To the impregnation liquid, a moistening agent is added, which improves the absorption of the liquid into the water-repellent paper. Several moistening agents, however, involve the drwback that they eliminate the water-repellent nature of the paper, i.e. make the paper water-absorbent.

In prior-art, two-component tensides are known, in which one part is hydrophobic and the other one hydrophilic. The hydrophilic part is eliminated when the paper is dried. As the hydrophobic part, fatty acids have been used, such as myristic acid. On the other hand, as the volatile hydrophilic component have been used amine compounds, for example monoethanolamine or diethanolamine.

Fatty-acid/ethanolamine tensides, however, involve a drawback of the large quantity of heat required for the evaporation of the ethanolamine.

The quantity of heat required for evaporation can be reduced by using tensides in which the volatile part is ammonia. However, owing to their instability, ammonium salts of fatty acids have proved unsatisfactory. They form fatty acid amides, which lowers the moistening effect.

The object of the present invention is to provide a method for the impregnation of paper, in which said method a moistening agent consisting of a hydrophobic part and a hydrophilic part is used, which said moistening agent is stable in the impregnation conditions and whose hydrophilic part can be eliminated easily during drying of the paper.

The object of the invention is achieved by using an ammonium salt of a succinic acid amide substituted with hydrocarbon groups as the moistening agent. The succinic acid amide is in particular monosubstituted with an aliphatic hydrocarbon group which contains 8 to 18 carbons. The substituent is preferably an alkenyl group that contains 10 to 14 carbons, such as a 2-dodecenyl group. The concentration of the moistening agent in the impregnation liquid is, e.g., 0.7 to 40 g/l, such as 2 to 20 g/l. The preferable concentration is 3 to 10 g/l, in particular 7 to 10 g/l.

The method in accordance with the invention is, in the other respects, accomplished in a way in itself known by treating the paper with a solution, dispersion or emulsion containing the desired additive as well as the moistening agent concerned and by thereupon drying the paper. During the drying, the moistening agent loses its moistening effect, and the water-repellent quality of the paper is restored.

By means of the method in accordance with the invention, it is possible, for example, to manufacture rot-proof packaging materials out of low-cost sized paper qualities. Of the objects of use should be mentioned brown kraft papers, of which, e.g., sacks, bags and wrapping paper are manufactured, as well as kraft liner, which is used commonly for the manufacture of corrugated fibreboard.

The moistening agent to be used may be illustrated by means of the formula $$\begin{array}{l} R-CHCONH_2 \\ \quad\;\; | \\ R'-CHCOONH_4 \end{array}$$

wherein R or R' is a hydrocarbon group, and one of the substituents may also be hydrogen.

These compounds can be prepared easily by to the corresponding succinic acid anhydride linking ammonia.

By the effect of heat, ammonia is liberated, and the compound is returned to anhydride.

It is known in prior art to use succinic acid anhydride derivatives substituted with an alkenyl group containing, on the average, 18 carbons as hydrophobing agents for paper, usually as stock sizes. The anhydride reacts with the hydroxyl groups in cellulose and forms an ester. The hydrophobing agent is used as minute quantities, and an emulsifyer, e.g. starch, is used with it. In surface sizing, corresponding salts have also been used, but even then the quantities are minute.

EXAMPLE 1

The moistening properties of two succinic acid derivatives were tested. The agents to be tested were: ammonium salt of 2-dodecenyl succinic acid amide (=D) (molar ratio succinic acid anhydride to ammonia 1:2) and ammonium salt of succinic acid amide substituted with an alkenyl group containing, on the average, 18 carbons (=R), which was prepared out of the commercial succinic acid anhydride "Raisafob MG", manufacturer Raision Tehtaat (molar ratio succinic acid anhydride to ammonia 1:2). The paper that was used was stock-sized kraft liner whose grammage was 250 g/sq.m.

The ability of absorption of the paper, i.e. the moistening effect of the moistening agent was determined by means of the Cobb value (SCAN standard 12:64) so that, in the Cobb assay, distilled water containing moistening agent was used. The absorption time of the solution was 10 s.

| Concentration of moistening agent wt % | Cobb 10 s/g/m | |
|---|---|---|
| | D | R |
| 0 | 15 | 15 |
| 0,1 | 104 | |
| 0,2 | 368 | |

-continued

| Concentration of moistening agent wt % | Cobb 10 s/g/m D | R |
|---|---|---|
| 0,3 | 509 | |
| 0,4 | 507 | |
| 0,5 | 596 | 31 |
| 1,0 | 570 | 39 |
| 2,0 | 530 | 89 |
| 3,5 | 547 | 250 |
| 4,0 | | 280 |
| 5,0 | | 360 |
| 6,0 | | 489 |
| 7,0 | 619 | 501 |
| 14,0 | 459 | 416 |

It is noticed that the ammonium salt of dodecenyl succinic acid amide is better than the salt of "Raisafob MG". Even an addition of 0.3% is enough to moisten the paper used completely.

EXAMPLE 2

The moistening properties of three succinic acid derivatives were tested. The derivatives to be tested were ammonium salt of 2-iso-octenyl succinic acid amide (="I") (molar ratio succinic acid anhydride to ammonia=1:2), ammonium salt of 2-dodecenyl succinic acid amide (="D"), and ammonium salt of amide prepared from "Raisafob MG" (="R").

The paper that was used was stock-sized kraft liner whose grammage was 200 g/sq.m.

The ability of absorption of the paper was determined by means of the Cobb value by using distilled water containing moistening agent. The absorption time of the water was 30 s.

| Concentration of moistening agent wt % | Cobb 30 s/g/m I | D | R |
|---|---|---|---|
| 0 | 20 | 20 | 20 |
| 0,1 | 23 | 121 | 27 |
| 0,2 | | 317 | |
| 0,3 | | 320 | |
| 0,4 | | 386 | |
| 0,5 | 29 | 406 | 29 |
| 0,6 | 69 | | |
| 0,7 | 111 | | |
| 0,8 | 211 | | |
| 0,9 | 304 | | |
| 1,0 | 311 | 476 | 70 |
| 2,0 | | | 230 |
| 3,0 | | | 335 |
| 4,0 | 376 | 427 | 396 |

EXAMPLE 3

Ammonium salts of 2-iso-octenyl succinic acid amide, of 2-dodecenyl succinic acid amide, and of succinic acid amide prepared from "Raisafob MG" (="I", "D" and "R") were tested.

The paper that was used was stock-sized kraft liner whose grammage was 200 g/sq.m.

The paper was impregnated with solutions of distilled water containing moistening agent, the concentrations of moistening agent in the solutions being:

I: 7 g/l

D: 1 g/l

R: 20 g/l

The moistening solution was absorbed into the paper completely, i.e. the papers became wet throughout.

Hereinafter the paper samples were dried as follows:

"3" the samples were dried at the room temperature for 3 weeks;

"5" the samples were dried at 150° C. for 5 min;

"10" the samples were dried at 150° C. for 10 min.

After drying, the ability of absorption of the paper was tested by means of the Cobb value by using distilled water. As a reference sample, moreover, untreated kraft liner (="0") was tested. The absorption time of the water was 30 s.

| Sample | Cobb 30 s/g/m |
|---|---|
| I3 | 31,8 |
| I5 | 30,0 |
| I10 | 24,8 |
| D3 | 16,9 |
| D5 | 14,0 |
| D10 | 12,3 |
| R3 | 59,6 |
| R5 | 25,6 |
| R10 | 12,1 |
| 0 | 22,0 |

It is noticed that the papers are water-repellent after drying. The moistening agent "D" permits the mildest drying conditions.

EXAMPLE 4

Tests were performed with a moistening agent in accordance with the invention, ammonium salt of dodecenyl succinic acid amide (="D"), as well as with reference agents, which were commercial "Berocell" moistening agents, manufacturer Berol Kemi Ab, which are cation-active, quaternary-amine-type moistening agents. As a reference sample (="0"), untreated paper was also studied.

The paper that was used was stock-sized kraft liner whose grammage was 250 g/sq.m.

The papers were impregnated with a water solution that contained moistening agent. All the samples except the 0-sample absorbed water completely. Hereinafter the samples were dried. The drying time was 10 min and the drying temperature 150° C. The ability of absorption of the paper was determined after drying by means of the Cobb value. Absorption time was 60 s.

| Sample | Addition to solution g/l | Cobb 60 s/g/m |
|---|---|---|
| Berocell 564 | 5 | 422 |
| Berocell 564 | 10 | 654 |
| Berocell 582 | 10 | 276 |
| Berocell 584 | 10 | 112 |
| D | 0,7 | 20 |
| " | 2,8 | 12 |
| " | 7,0 | 16 |
| O | 0 | 44 |

It is noticed that the samples treated as per the invention were water-repellent after drying.

What is claimed is:

1. Method for the impregnation of water-repellent paper, in which said method the paper is treated with an impregnation liquid and with a moistening agent and is thereinafter dried, characterized in that the moistening agent used is an ammonium salt of a substituted succinic acid amide.

2. Method as claimed in claim 1, characterized in that the succinic acid amide is monosubstituted.

3. Method as claimed in claim 2, characterized in that the substituent is an aliphatic hydrocarbon group that contains 8 to 18 carbon atoms.

4. Method as claimed in claim 3, characterized in that the substituent is an alkenyl group that contains 10 to 14 carbon atoms.

5. Method as claimed in claim 4, characterized in that the substituent is a 2-dodecenyl group.

6. Method as claimed in claim 1, characterized in that the ammonium salt of succinic acid amide is used as a concentration of 0.7 to 40 g/l.

7. Method as claimed in claim 6, characterized in that the ammonium salt of succinic acid amide is used as a concentration of 2 to 20 g/l.

8. Method as claimed in claim 7, characterized in that the ammonium salt of succinic acid amide is used as a concentration of 3 to 10 g/l.

9. Method as claimed in claim 7, characterized in that the ammonium salt of succinic acid amide is used as a concentration of 7 to 10 g/l.

* * * * *